US008699865B2

(12) United States Patent
Falcou et al.

(10) Patent No.: US 8,699,865 B2
(45) Date of Patent: Apr. 15, 2014

(54) DECOY SYSTEM, NOTABLY FOR IMPROVISED EXPLOSIVE DEVICES

(75) Inventors: Gèrard Falcou, Sollies-Toucas (FR); Patrick Angeloni, Hyeres (FR)

(73) Assignee: ECA, La Garde (FR)

( * ) Notice: Subject to any disclaimer, the term of this patent is extended or adjusted under 35 U.S.C. 154(b) by 929 days.

(21) Appl. No.: 12/752,865

(22) Filed: Apr. 1, 2010

(65) Prior Publication Data

US 2011/0170845 A1 Jul. 14, 2011

(30) Foreign Application Priority Data

Apr. 3, 2009 (FR) ..... 09 52203

(51) Int. Cl.
*F24D 13/00* (2006.01)

(52) U.S. Cl.
USPC ..... 392/347; 392/354; 392/355

(58) Field of Classification Search
None
See application file for complete search history.

(56) References Cited

U.S. PATENT DOCUMENTS 2,178,049 A * 10/1939 Mouton et al. ..... 219/449.1
2,655,346 A * 10/1953 Dale et al. ..... 165/135
3,825,059 A * 7/1974 Laing ..... 165/10
4,088,183 A * 5/1978 Anzai et al. ..... 165/10
4,467,179 A * 8/1984 Ali et al. ..... 392/353
4,977,952 A * 12/1990 Schatz ..... 165/10
5,222,298 A * 6/1993 Schatz ..... 29/890.03
5,950,708 A * 9/1999 Schatz ..... 165/10
6,561,072 B1 5/2003 Laine et al.

FOREIGN PATENT DOCUMENTS

DE 3832534 4/1990
DE 0640809 3/1995
EP 0536510 4/1993

OTHER PUBLICATIONS

French Search Report for FR 0952203.

* cited by examiner

*Primary Examiner* — Thor Campbell
(74) *Attorney, Agent, or Firm* — Meyertons, Hood, Kivlin, Kowert & Goetzel, P.C.; Eric B. Meyertons

(57) ABSTRACT

The decoy system, notably for terrestrial mines or improvised explosive devices, includes: a means of producing heat energy including an air or water boiler, a means of emitting radiation in the infrared spectrum including a chamber that is fed with fluid by the production means, the chamber being provided with internal fins able to promote a build-up of heat energy inside said chamber, at least one detection means for determining the temperature of the chamber or the temperature of the fluid between the production means and the emission means, and a control unit able to control the operation of the heat energy production means at least according to the determined temperature.

10 Claims, 4 Drawing Sheets

DECOY SYSTEM, NOTABLY FOR IMPROVISED EXPLOSIVE DEVICES

BACKGROUND OF THE INVENTION

1. Field of the Invention

The present invention generally relates to the field of decoy systems, notably for mines or explosive devices, laid, buried or more generally arranged at the roadside. More specifically, the invention relates to the decoying of improvised explosive devices which usually contain destructive, flammable and/or deadly chemical products that are commonly called IED (improvised explosive devices). The invention also relates, generally, to the decoy systems or decoys that make it possible to provoke the triggering of explosive devices or mines buried or placed at the roadside.

2. Description of the Relevant Art

Conventionally, decoy systems or decoys are used to provoke the explosion of mines or explosive devices at a distance from the mine-clearing vehicles.

To this end, the decoy systems can comprise means for emitting radiation in the infrared spectrum so as to be detected by these devices or mines that include infrared sensors.

To allow for the emission of such radiation, one solution consists in fitting, between two metallic plates, an electrical resistance powered by an energy source.

In order to ensure an emission of infrared radiation that is likely to provoke the triggering of both mines and improvised explosive devices, it is, however, necessary for the electrical energy power source to be able to have a relatively high power, of the order of several kilowatts.

This is incompatible with an embedded system on-board a vehicle or pushed by a mine-clearing vehicle that also has to be used for several hours. Moreover, with this solution, the temperature rise time of the system is relatively great.

In order to provide the infrared radiation emission means with an input of electrical energy that is sufficient to allow for the triggering of mines and improvised explosive devices, it is possible to use a generator set. However, this solution has the major drawbacks of being relatively bulky and very heavy.

Also known, from the European Patent 1 054 230, is a decoy system linked to the front of a tank and mainly comprising vertical panels on which are provided metal conductors powered by the electric batteries of the tank to control their temperature.

The purpose of this system is to reproduce emissivity in the infrared range close to that of a tank to allow for the triggering of roadside mines. In this respect, one area of the panels can be slaved to a temperature of between 15 and 20° C. above ambient temperature, whereas a neighboring area of the panels can be slaved to a lower temperature, for example between 5 and 10° C. above ambient temperature.

Given the heat dissipation, the electrical energy supplied to the panels by the batteries can prove insufficient to allow for the triggering of roadside mines as soon as the tank is moving at relatively high speeds, of the order of 50 kilometers per hour.

Moreover, the electrical energy likely to be delivered by the batteries of the tank does not make it possible to obtain a sufficient temperature on the panels to allow for the triggering of improvised explosive devices. In practice, such devices usually explode when they detect a temperature higher than those recommended in EP 1 054 230.

SUMMARY OF THE INVENTION

The aim of the present embodiments is to remedy the drawbacks of the prior art systems.

More particularly, the embodiments herein provide a decoy system, notably for terrestrial improvised explosive devices, that is autonomous, cost-effective and compact.

Another aim of the embodiments is to provide a decoy system for which the temperature rise time, when it is started up, is relatively short.

A further aim of the embodiments is to provide a system that makes it possible to trigger both mines arranged at the roadside and also improvised explosive devices.

In one embodiment, the decoy system, notably for mines or terrestrial improvised explosive devices, is provided with a means of producing heat energy including an air or water boiler and a means of emitting radiation in the infrared spectrum including a chamber fed with fluid by the heat energy production means. The chamber is provided with internal fins able to promote a build-up of heat energy inside the latter. The system also includes at least one detection means for determining the temperature of the chamber or the temperature of the fluid between the production means and the emission means, and a control unit able to control the operation of the means of producing heat energy at least according to the determined temperature.

In one embodiment, the system also includes an outside temperature sensor. The control unit is able to drive the production means so that the difference between the detected temperatures is greater than a predetermined threshold value and able to check that said difference is at least equal to said threshold value.

Advantageously, the internal fins extend perpendicularly to the inlet stream into the chamber of the fluid emitted by the heat energy production means. The internal fins can be arranged in the form of successive rows, parallel or not, the fins of one row being separated so as to delimit a space located at least partly facing an orifice feeding the chamber with fluid. Advantageously, the dimension of the space provided between the internal fins of a row decreases progressively from one row of fins to another. The space between the fins is greatest for the row located in the vicinity of the feed orifice.

In one embodiment, the chamber includes substantially smooth outer walls.

Advantageously, the boiler includes an exhaust duct for gases passing through the chamber.

The chamber can include at least one fluid outlet orifice and, possibly, an associated closing valve. The position of the closing valve can be modified manually or mechanically via the control unit.

In one embodiment, a recirculation duct tapped onto the chamber is provided to reinject, partially or totally inside the boiler, the fluid from the chamber. This duct extends between the chamber and the boiler and is in fluidic communication with them.

In one embodiment, the means of detecting the temperature of the chamber includes a temperature sensor.

In one embodiment, the control unit is able to control the operation of the energy production means according to the difference between the measured temperatures.

BRIEF DESCRIPTION OF THE DRAWINGS

The present invention will be better understood from reading the detailed description of an embodiment taken as a nonlimiting example and illustrated by the appended drawings, in which.

Figure 1:
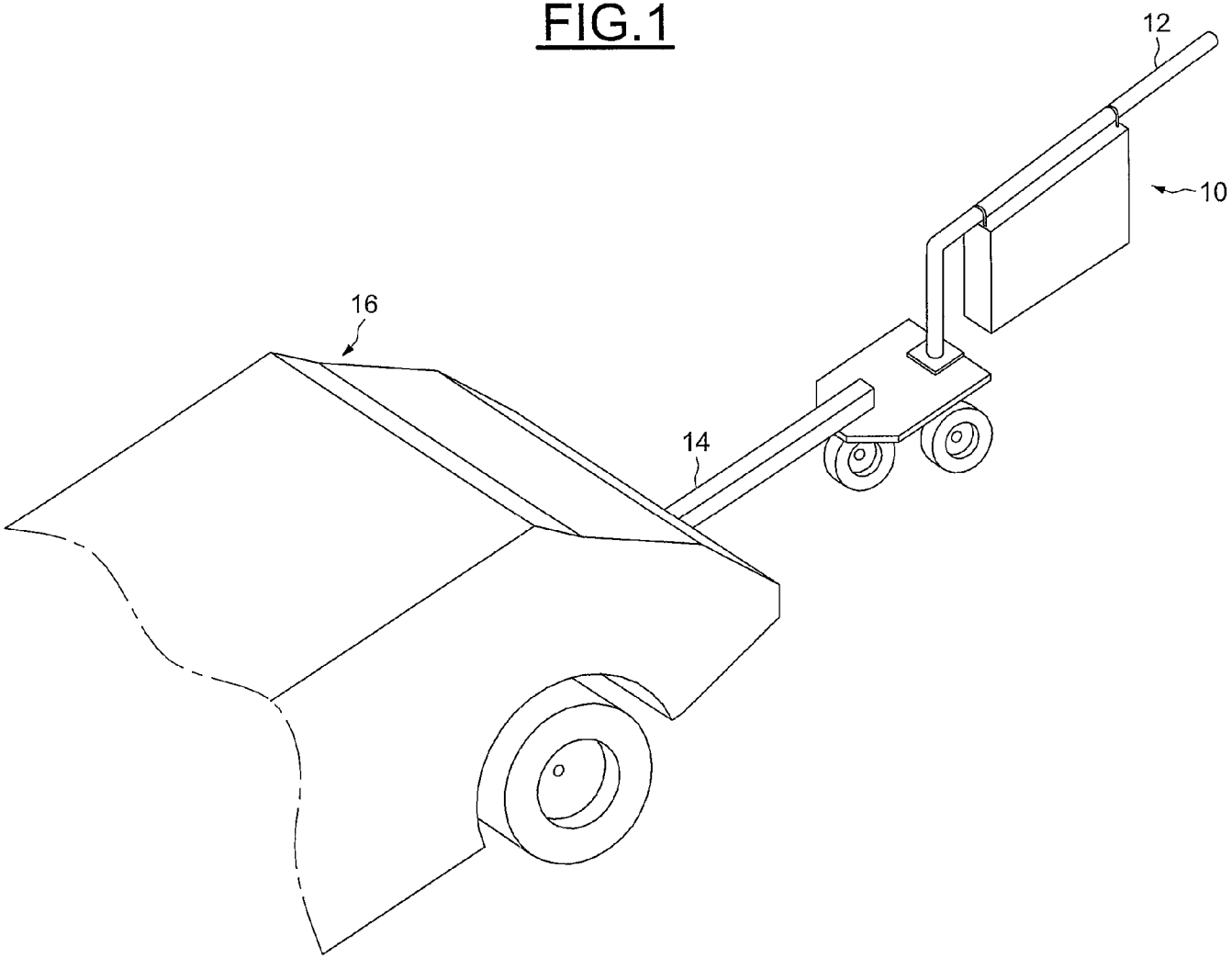
FIGS. 1 to 3 diagrammatically represent a decoy system.

While the invention may be susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives failing within the spirit and scope of the present invention as defined by the appended claims.

DETAILED DESCRIPTION OF THE PREFERRED EMBODIMENTS

Figure 2:
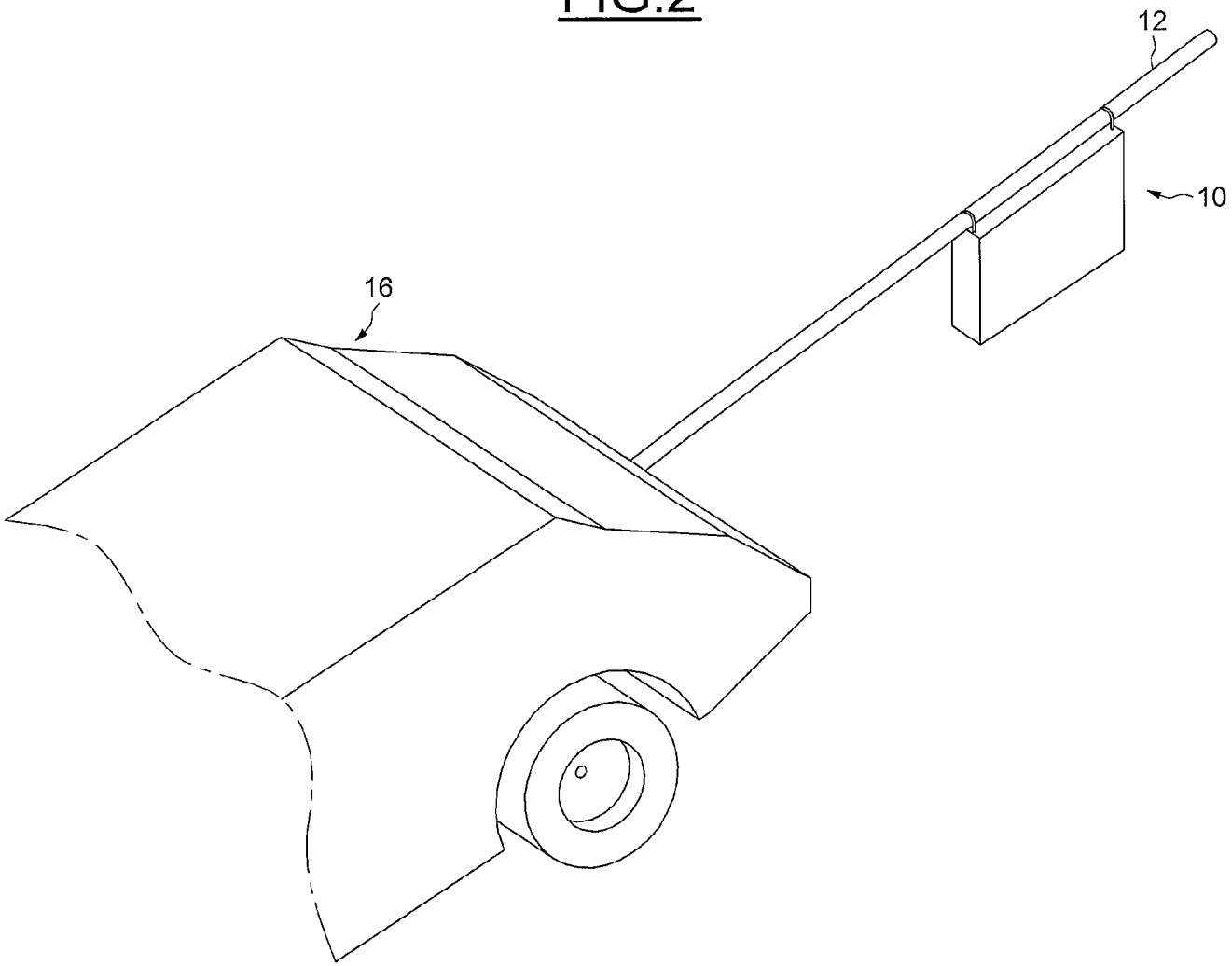

FIG. 1 diagrammatically represents a decoy system 10 mounted on a supporting mast 12, which is in turn fixed to a towing bar 14 which is attached to the front part of a vehicle 16. As illustrated in FIG. 2, the supporting mast 12 can alternatively be fixed directly to the front of the vehicle 16.

The decoy system 10 is particularly suitable for making it possible, ahead of the passage of the vehicle 16, to trip a mine or improvised explosive device laid on a road or buried. The distance separating the system 10 and the front of the vehicle 16 is sufficiently great to avoid destruction of the vehicle 16 when the mine or device explodes.

Figure 3:
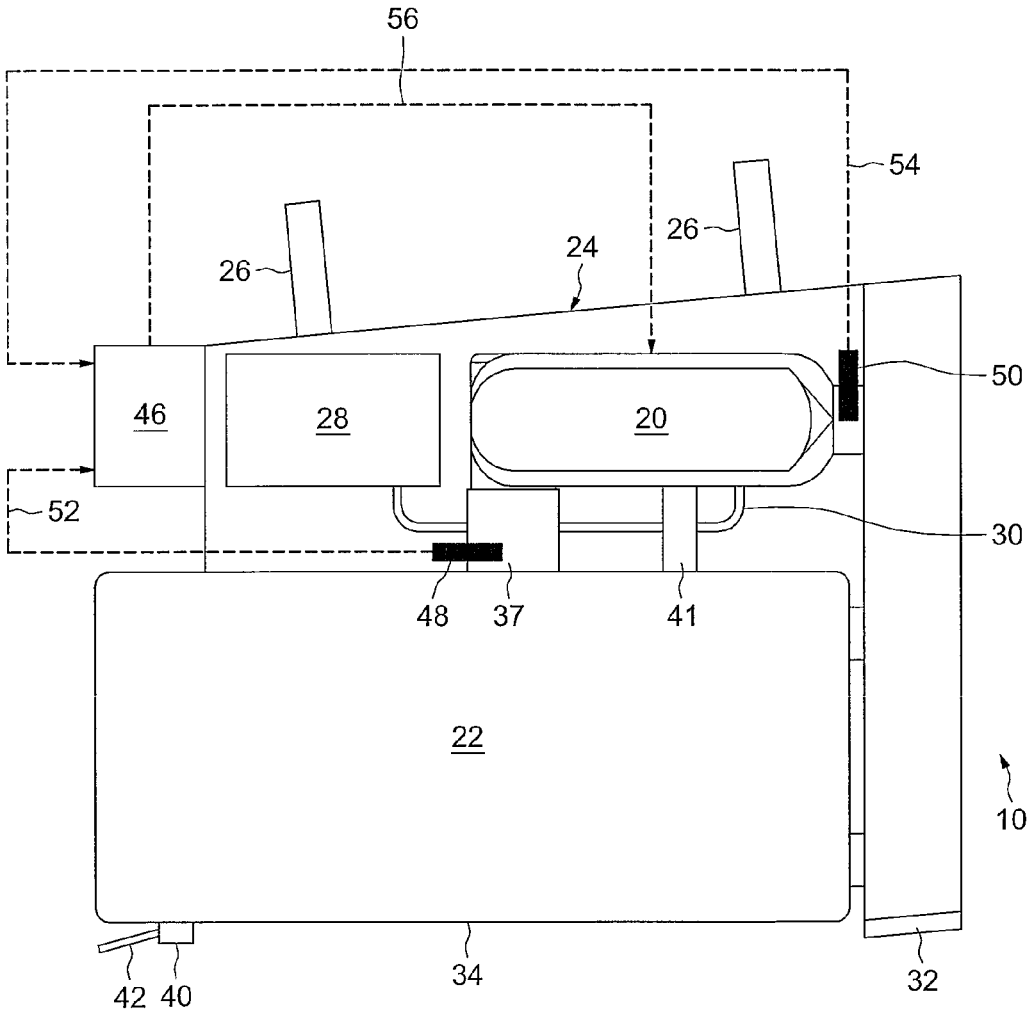

As illustrated more visibly in FIG. 3, the decoy system 10 mainly includes a boiler 20 for the production of heat energy and an infrared radiation emission means 22 supplied with fluid by the boiler. The boiler 20 and the emission means 22 are fixed by any appropriate means to a supporting shielding 24. The supporting shielding 24 includes clamping plates 26 and screws (not represented) for adjusting the position of and securing the system 10 on the mast 12 (FIGS. 1 and 2). The emission means 22 is in a vertical position so as to be able to be detected by the sensor associated with the mine or explosive device.

The boiler 20 is used to reheat a fluid, in this case air, and direct it to the means 22 for the purpose of the emission of radiations, in the infrared spectrum, likely to provoke the tripping of a mine or improvised explosive device.

The boiler 20 is connected to a fuel tank 28 via a duct 30. The boiler 20 includes a burner, a dosing pump and a ventilation means (not represented). The ventilation means sucks in air from an inlet opening 32 provided at a bottom end of the shielding 24 and expels it toward an exhaust duct 41, after having mixed it with the fuel pumped from the tank 28 then passed through the burner. The reheated air at the outlet of the boiler 20 is conveyed by a duct 37 to feed the emission means 22. As an indication, the boiler 20 can have a length of 550 mm, and a width and a thickness of 200 mm. In this embodiment, the boiler is of the air type. Alternatively, it is, however, possible to provide a water boiler to feed the emission means 22 with heat energy.

Figure 4:
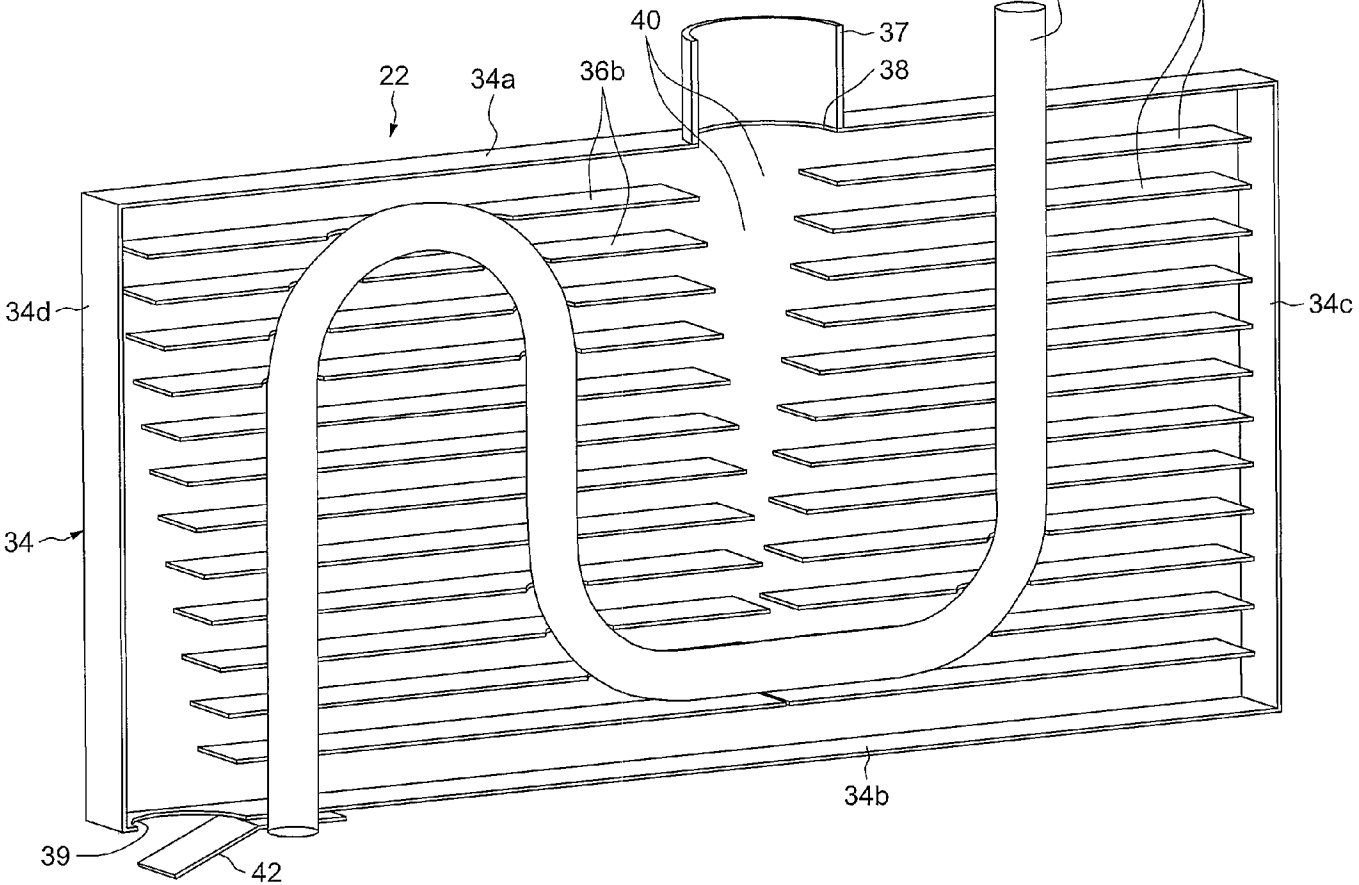
FIG. 4 is a perspective cross-sectional view of an infrared radiation emission means of the system of FIGS. 1 to 3.

There now follows a description, with reference to FIG. 4, of the infrared radiation emission means 22. The emission means 22 is represented here in cross section, the part of the emission means 22 not illustrated in the figure being identical to that which will be described.

The emission means 22 includes a sealed chamber 34 provided internally with fins 36*a*, 36*b* arranged in the form of parallel successive rows, in this case twelve such rows. The chamber 34 is made of light alloy and here has a generally parallelepipedal shape. Obviously, the chamber 34 could have a different overall shape. Alternatively, it could also be possible to provide non-parallel fins. As an indication, the chamber 34 can have a height of 400 mm, a width of 800 mm and a thickness of 110 mm. The system 10 can have a weight of approximately 30 kg. The chamber 34 includes pairs of opposite edges 34*a*, 34*b* and 34*c*, 34*d*. In this figure, the emission means 22 is represented in a position that is assumed to be vertical. The edges 34*a*, 34*b* therefore respectively constitute top and bottom edges. The chamber 34 is fed with hot air via the duct 37 which extends from the boiler 20 and is fixedly mounted inside a feed orifice 38 provided in the top edge 34*a*.

As indicated previously, the horizontal internal fins 36*a*, 36*b* are arranged in the form of parallel successive rows. The vertical spacing provided between two immediately adjacent rows of fins is constant.

The fins 36*a*, 36*b* extend between the edges 34*c* and 34*d*, being parallel to the edges 34*a* and 34*b*. The fins 36*a*, 36*b* of the first row situated in the vicinity of the duct 37 occupy substantially most of the width of the chamber 34 between the edges 34*c*, 34*d*. A first fin 36*a* of this row extends from the edge 34*c* to the vicinity of an area situated in the extension of the duct 37, i.e. facing the feed orifice 38. The second fin 36*b* extends horizontally in the extension of the first fin 36*a* while being laterally offset relative to the latter until it reaches the vicinity of the edge 34*d*, while allowing a small space to remain between it and said edge. The fins 36*a*, 36*b* of the first row are separated from one another so as to delimit a space 40 situated facing the feed orifice 38. The lateral dimension of the space 40 is substantially equal to the diameter of the feed orifice 38. The space 40 allows the air inlet flow to be directed to the subsequent rows of fins 36*a*, 36*b*.

Downstream of the first row, using the direction of circulation of the air inside the chamber 34 as a reference, the second row includes a fin 36*a* extending from the edge 34*c*. The fin 36*a* of the second row has a length slightly greater than that of the fin 36*a* of the first row. The fin 36*b* of the second row has a length identical to that of the first row while, however, being offset toward the fin 36*a* of the second row so that the space 40 between fins of that row is slightly less than that of the first row. Thus, a greater space is provided between the fin 36*b* of the second row and the edge 34*d*.

The arrangement of each of the subsequent rows of fins relative to the immediately preceding row is similar to that of the second row with respect to the first row. Thus, the space 40 between the fins 36*a*, 36*b* of one and the same row gradually decreases with distance away from the feed orifice 38 so that, for the last row of fins 36*a* and 36*b* situated in proximity to the bottom edge 34*b*, the space between the two fins is almost zero. The space between the fin 36*b* of this last row and the edge 34*d* is substantially equal to the diameter of an outlet orifice 39 provided in the thickness of the bottom edge 34*b* in the vicinity of the edge 34*d*. The applicant has determined that the provision of a space 40 between fins that has a general V shape and decreases with distance away from the feed orifice 38 allows for a better distribution of the heat inside the chamber 34. Thus, a relatively uniform temperature of the chamber 34 is obtained.

The fins 36*a*, 36*b* of the different rows are arranged perpendicularly to the direction of flow of the air at the outlet of the duct 37 so as to retain this air flow within the chamber 34 while progressively orienting it toward the outlet orifice 39. The arrangement of the internal fins 36*a*, 36*b* in the chamber 34 tends to favor the concentration of heat inside the latter so as to facilitate the emission of an infrared radiation that is substantially greater than the ambient infrared radiation. The appearance of a hot area or spot that can be detected by a mine or improvised explosive device is thus obtained. Obviously, it could be possible to provide a different arrangement of the fins 36*a*, 36*b* also tending to favor the concentration of heat. Furthermore, so as to limit the heat dissipation by the emission means 22, the outer walls of the chamber 34 are substantially smooth, i.e. without any fins or other means favoring the evacuation of heat.

To adjust the hot air flow rate at the outlet from the chamber 34, the latter includes a valve 42, the position of which can be modified manually or mechanically, for example as a function of the outside temperature, so as to vary the degree of opening of the outlet orifice 39. Alternatively, it is possible not to provide such a valve.

In a variant embodiment, it is also possible to provide a closed circuit mode of operation of the system. To this end, the chamber 34 includes, instead of the outlet orifice 39 or in association with said orifice and its closing valve 42, a recirculation duct communicating with the inside of the chamber and reinjecting the hot air, or water, obtained from the chamber inside the boiler. Such a closed circuit mode of operation is possible by virtue of the use of an air or water boiler.

The exhaust duct 41 for the gases from the boiler 20 snakes up and down inside the chamber 34. The exhaust duct 41 extends through the top edge 34*a* in the vicinity of the duct 37 and discharges through the bottom edge 34*b* in proximity to the outlet orifice 39. The exhaust duct 41 participates in the raising of the temperature of the chamber 34 when the system 10 is started up, thus helping to reduce the time needed for the emission of the desired infrared radiation.

Referring once again to FIG. 3, the decoy system 10 also includes a control unit 46 fixed to the shielding 24 and controlling the operation of the boiler 20 as a function of the infrared radiation to be emitted.

To this end, the system 10 includes a temperature sensor 48 mounted in the duct 37 and able to measure the temperature of the hot air at the outlet of the boiler 20 which is conveyed to the chamber 34. The system 10 also includes a temperature sensor 50 mounted on the shielding 24 between the inlet opening 32 and the inlet of the boiler 20 so as to measure the temperature of the outside air that is directed toward said boiler. The temperature sensors 48, 50 are connected to the control unit 46 via connections 52, 54 that are diagrammatically illustrated as dotted lines.

The control unit 46 includes, stored in memory, all the hardware and software means that make it possible to control the operation of the boiler 20 on the basis of measurements made by the sensors 48, 50. In this respect, the control unit 46 determines the difference between the temperature of the hot air entering into the chamber 34 and the outside temperature, and compares it to a predetermined threshold value. If the temperature difference is below the threshold value, an alarm signal that can be visual or audible is triggered by the control unit 46 to signal a failure of the operation of the boiler 20. As a variant, the control unit 46 can drive the operation of the boiler 20 so as to maintain the difference between the temperature of the hot air entering into the chamber 34 and the outside temperature at a fixed value.

In the embodiment described, the operation of the boiler is controlled and/or driven on the basis of the temperature measurements of the hot air introduced into the chamber 34 and of the outside air. It will be understood that it is also possible, without departing from the framework of the invention, to provide for the mounting of one or more temperature sensors directly inside the chamber 34 replacing the temperature sensor of the hot air mounted in the duct 37. In the case of a plurality of temperature sensors mounted in the chamber 34 in different places, it is possible to provide for the control unit 46 to calculate an average of the measured temperatures in order to obtain a value representative of the temperature of the walls of the chamber 34.

In a variant embodiment, it is also possible to determine the temperature of the chamber 34 by means of charts or maps stored in the control unit 46 and obtained from previous trials on the basis of temperature measurements on the hot air introduced inside the latter, of the temperature of the outside air, and of the speed of the vehicle 16 to which the system 10 is attached.

Alternatively, it is also possible to provide for the control unit 46 to drive the operation of the boiler 20, and therefore that of the emission means 22, only as a function of the temperature of the chamber 34 determined by the sensor or sensors, i.e., without considering the temperature of the outside air.

In the embodiments described, the sensor or sensors provided for measuring the temperature of the hot air in the duct 37 or in the chamber 34 are temperature sensors. Alternatively, to measure the temperature of the chamber 34 or of the air inside the duct 37, it could be possible to provide a thermal analysis infrared sensor able to detect the infrared radiation emitted and convert it into an electrical signal in order for the control unit 46 to determine the temperature of the chamber 34 or of the air inside the duct 37.

When the system 10 is intended for use at altitude, for example above 1500 meters, it is possible to provide, in addition, an atmospheric pressure sensor (not represented) mounted on the shielding 24 and directly connected to the boiler so as to be able to regulate its combustion according to the density of the air to be burned, which reduces with altitude.

The means 22 makes it possible to obtain, continuously, at the level of the chamber 34, a temperature substantially greater than that which can be obtained with other technologies with comparable supplied energy, which makes it possible to generate a significant temperature difference with the outside temperature so as to be able to be detected equally by a mine arranged at the roadside and by an improvised explosive device, and to do so even when the speed of displacement of the vehicle 16 is relatively high, of the order of 50 kilometers per hour. Furthermore, with the system 10, a relatively short temperature rise time of the chamber 34 is obtained and the system can operate autonomously for several tens of hours at a stretch. It is, moreover, relatively compact and lightweight.

In the application described, the system 10 is pushed by a following vehicle 16. It will easily be understood that this vehicle 16 can be a transport vehicle or else a remotely-operated vehicle. As indicated previously, the system 10 is particularly suitable for the decoying of mines or improvised explosive devices. The system can, however, be used for other applications, for example for decoying infrared airborne missiles.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A decoy system, notably for terrestrial mines or improvised explosive devices, comprising:

a means of producing heat energy comprising an air or water boiler, a means of emitting radiation in the infrared spectrum comprising a chamber that is fed with fluid by the production means, the chamber being provided with internal fins able to promote a build-up of heat energy inside said chamber wherein the internal fins are arranged in the form of successive parallel rows, and wherein the fins of one or more rows are separated so as to delimit a space aligned with an orifice feeding the chamber with fluid, at least one detection means for determining the temperature of the chamber or the temperature of the fluid between the production means and the emission means, and a control unit able to control the operation of the means of producing heat energy at least according to the determined temperature.

2. The system according to claim 1, further comprising an outside temperature sensor, the control unit being able to drive the production means so that the difference between the detected temperatures is greater than a predetermined threshold value and able to check that said difference is at least equal to said threshold value.

3. The system according to claim 1, in which the internal fins extend perpendicularly to an inlet stream of the fluid into the chamber.

4. The system according to claim 1, in which the dimension of the space provided between the internal fins of a row decreases progressively from one row of fins to another, the space between the fins being greatest for the row located in the vicinity of the feed orifice.

5. The system according to claim 1, in which the chamber comprises substantially smooth outer walls.

6. The system according to claim 1, in which the boiler comprises an exhaust duct for gases passing through the chamber.

7. The system according to claim 1, in which the chamber comprises at least one fluid outlet orifice.

8. The system according to claim 7, in which the chamber includes a valve for closing the outlet orifice.

9. The system according to claim 1, comprising a recirculation duct for the fluid from the chamber linked to the heat energy production means.

10. The system according to claim 1, in which the means of detecting the temperature of the chamber comprises a temperature sensor.

* * * * *